US009120546B1

(12) United States Patent
Geder et al.

(10) Patent No.: US 9,120,546 B1
(45) Date of Patent: Sep. 1, 2015

(54) ACTIVELY CONTROLLED CURVATURE ROBOTIC PECTORAL FIN

(71) Applicants: Jason D. Geder, Arlington, VA (US); John S. Palmisano, Silver Spring, MD (US); Marius D. Pruessner, Silver Spring, MD (US); Ravi Ramamurti, Silver Spring, MD (US)

(72) Inventors: Jason D. Geder, Arlington, VA (US); John S. Palmisano, Silver Spring, MD (US); Marius D. Pruessner, Silver Spring, MD (US); Ravi Ramamurti, Silver Spring, MD (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/710,706

(22) Filed: May 13, 2015

Related U.S. Application Data

(62) Division of application No. 13/987,921, filed on Sep. 17, 2013, now Pat. No. 9,045,211.

(51) Int. Cl.
*B63H 1/37* (2006.01)
*B63H 5/00* (2006.01)

(52) U.S. Cl.
CPC .. *B63H 1/37* (2013.01); *B63H 5/00* (2013.01); *Y10S 901/01* (2013.01)

(58) Field of Classification Search
USPC ..... 701/21
See application file for complete search history.

(56) References Cited

U.S. PATENT DOCUMENTS 2,771,618 A * 11/1956 Crum ..... 441/59
2,960,959 A * 11/1960 Chadwick, Jr. et al. ..... 114/126
3,020,869 A * 2/1962 Beach ..... 114/126
3,091,210 A * 5/1963 Akutowicz ..... 416/81
3,406,759 A * 10/1968 Nutku ..... 416/20 R
3,448,714 A * 6/1969 Brooks ..... 114/162

(Continued)

FOREIGN PATENT DOCUMENTS

CN 201437333 U * 4/2010
CN 202464110 U 10/2012

(Continued)

OTHER PUBLICATIONS

Hobson, B., et al., "PilotFish: Maximizing agility in an unmanned underwater vehicle," Proceedings of the International Symposium on Unmanned Untethered Submersible Technology, Durham, NH, pp. 41-51, 1999.

(Continued)

*Primary Examiner* — Shelley Chen
(74) *Attorney, Agent, or Firm* — US Naval Research Laboratory; Sally A. Ferrett; John Leonard Young

(57) ABSTRACT

A robotic mechanical fin, having a motor housing containing a plurality of rib rotation motors, rib spars, and a plurality of ribs, mechanically movable and communicatively coupled to the plurality of rib rotation motors and shafts, where the plurality of ribs are rotationally coupled to and actuated by the plurality of rib rotation motors and shafts. The mechanical fin further includes a flexible fin casing, within which the ribs reside, forming the complete actively controlled curvature robotic propulsion and steering apparatus. The mechanical fin is connected to a plurality of control electronics circuits and a computer processor programmed with actuation code that when executed by the computer processor causes automated actuation of simultaneous propulsion and steering maneuverability of the actively controlled curvature, robotic, mechanical fin.

17 Claims, 9 Drawing Sheets

(56) References Cited

U.S. PATENT DOCUMENTS

| | | | | |
|---|---|---|---|---|
| 3,453,981 | A * | 7/1969 | Gause | 440/9 |
| 3,727,572 | A * | 4/1973 | Nelson et al. | 114/126 |
| 5,401,196 | A | 3/1995 | Triantafyllou et al. | |
| 6,089,178 | A | 7/2000 | Yamamoto et al. | |
| 6,250,585 | B1 * | 6/2001 | Pell | 244/22 |
| 6,332,756 | B1 * | 12/2001 | Yanagisawa | 416/81 |
| 6,500,033 | B1 | 12/2002 | Sagov | |
| 6,835,108 | B1 | 12/2004 | Gieseke | |
| 2002/0025744 | A1 * | 2/2002 | McCarthy | 441/64 |
| 2002/0174818 | A1 * | 11/2002 | von Wolske | 114/286 |
| 2006/0019555 | A1 * | 1/2006 | McGuinness | 440/21 |
| 2008/0108259 | A1 * | 5/2008 | Melius | 441/64 |
| 2008/0257245 | A1 * | 10/2008 | Stella | 114/126 |
| 2010/0285703 | A1 * | 11/2010 | Vermeiden | 440/14 |

FOREIGN PATENT DOCUMENTS

| | | | |
|---|---|---|---|
| CN | 103213665 | A | 7/2013 |
| JP | 2002-136776 | A | 5/2002 |
| KR | 101219643 | | 1/2013 |

OTHER PUBLICATIONS

Kato, N., et al., "Elastic pectoral fin actuators for biomimetic underwater vehicles," in Bio-mechanisms of Swimming and Flying, Springer Japan, chap. 9, pp. 271-282, Jan. 2008.

Palmisano, J.; Geder, J.; Ramamurti, R.; Liu, K.-J.; Cohen, J.; Mengesha, T.; Naciri, J.; Sandberg, W.; Ratna, B.; "Design, development, and testing of flapping fins with actively controlled curvature for an unmanned underwater vehicle", Bio-mechanisms of Swimming and Flying, Springer Japan, pp. 283-294, Jan. 2008.

Colgate, J.E., et al., "Mechanics and control of swimming: a review," IEEE Journal of Oceanic Engineering, vol. 29, pp. 660-673, Jul. 2004.

Liao, J.C., "A review of fish swimming mechanics and behavior in altered flows," Philosophical Transactions of the Royal Society B., vol. 362 (1487), pp. 1973-1993, Nov. 2007.

Licht, S., et al., "Design and projected performance of a flapping foil AUV," IEEE Journal of Oceanic Engineering, vol. 29, No. 3, pp. 786-794, Jul. 2004.

Moored, K.W., et al., "Investigating the thrust production of a myliobatoid-inspired oscillating wing," 3rd International CIMTEC Conference, Acireal, Italy, Jun. 8-13, 2008, 6 pages.

Sitorus, P., et al., "Design and implementation of paired pectoral fins locomotion of labriform fish applied to a fish robot," Journal of Bionic Engineering, vol. 6, No. 1, pp. 37-45, Mar. 2009.

Tangorra, J., et al., "The effect of fin ray flexural ridgidity on the propulsive forces generated by a biorobetic fish pectoral fin," The Journal of Experimental Biology, vol. 213, pp. 4043-4054, Dec. 2010.

Geder, J.D.; Ramamurti, R.; Palmisano, J.; Pruessner M.; "Dynamic Performance of a Bio-Inspired UUV: Effects of Fin Gaits and Orientation" Proceedings of the 17th International Symposium on Unmanned Untethered Submersible Technology, Aug. 21-24, 2011, 8 pages.

Geder, J.; Ratna, B.; Palmisano, J.S.; Ramamurti, R.; 15th International Symposium on Unmanned Untethered Submersible Technology, 11 pages, Aug. 2007.

Geder, J.; Ramamurti, R.; Palmisano, J.; Pruessner, M.; Ratna, B.; Sandberg, W.C.; "Sensor Data Fusion and Submerged Test Results of a Pectoral Fin Propelled UUV", 16th Int. Symposium on Unmanned Untethered Submersible Technology, Aug. 2009, pp. 23-26.

Geder, J.D.; Palmisano, J.S.; Ramamurti, R.; Pruessner, M.; Ratna, B.; Sandberg, W.C.; "Bioinspired Design Process for an Underwater Flying and Hovering Vehicle", Marine Technology Society Journal, vol. 45, No. 4, pp. 74-82, Jul. 2011.

Ramamurti, R.; Geder, J.; "Development of a Four-Fin Bio-Inspired UUV: CFD Studies", Naval Research Laboratory Memorandum Rpt., NRL/MR/6040-12-9426, Sep. 4, 2012, 39 pages.

Geder, J.; Sandberg, W.C.; Ramamurti, R.; "Multi-Camera, High-Speed Imaging System for Kinematics Data Collection", Naval Research Laboratory Memorandum Report, NRL/MR/6401-07-9054, Sep. 21, 2007, 15 pages.

Geder, J.D.; Ramamurti, R.; Palmisano, J.; Pruessner, M.; Ratna, B.; Sandberg, W.C.; "Four-fin bio-inspired UUV: Modeling and control solutions", ASME 2011 International Mechanical Engineering Congress and Exposition, Jan. 2011, pp. 799-808.

Geder, J.D.; Ramamurti, R.; Palmisano, J.; Pruessner, M.; Ratna, B.; Sandberg, W.C.; "Scaling studies for an actively controlled curvature robotic pectoral fin", Intelligent Robotics and Applications, Springer Berlin Heidelberg, pp. 141-150, Jan. 2012.

Geder, J.D.; Ramamurti, R.; Pruessner, M.; Ratna, B.; Palmisano, J.;Sandberg, W.; "Bio-Inspired Locomotion for Unmanned Underwater Vehicles", 2012 NRL Review, pp. 204-211, May 2013.

Geder, J.D.; Palmisano, J.; Ramamurti, R.; Ratna, B.; Sandberg, W.C.; "Fuzzy logic PID based control design and performance for a pectoral fin propelled unmanned underwater vehicle", ICCAS 2008, International Conference on Control, Automation and Systems, Oct. 2008, IEEE, pp. 40-46.

Palmisano, J.S.; Ramamurti, R.; Geder, J.D., Pruessner, M.; Sandberg, W.C.; Ratna, B.; "How to Maximize Pectoral Fin Efficiency by Control of Flapping Frequency and Amplitude", 18th International Symposium on Unmanned Untethered Submersible Technology, Aug. 11-13, 2013, 9 pages.

Palmisano, J., et al., "Design of a biomimetic controlled-curvature robotic pectoral fin," IEEE International Conference on Robotics and Automation, Rome, Italy, Apr. 10-14, 2007, 8 pages.

Palmisano, J.S.; Geder, J.; Pruessner, M.; Ramamurti, R.; "Power and Thrust Comparison of Bio-mimetic Pectoral Fins with Traditional Propeller-based Thrusters", 18th Int. Symposium on Unmanned Untethered Submersible Technology, Aug. 11-13, 2013, 9 pages.

Palmisano, J.S.; Pruessner, M.; Geder, J.D.; "A Comprehensive Allometric Analysis of Bio-Mimetic MPF-Type UUVs", 18th International Symposium on Unmanned Untethered Submersible Technology, Aug. 11-13, 2013, 10 pages.

Palmisano, J.S.; Geder, J.D.; Ramamurti, R.; Sandberg, W.C.; Ratna, B.; "Robotic pectoral fin thrust vectoring using weighted gait combinations", Applied Bionics and Biomechanics, vol. 9, No. 3, pp. 333-345, Jul. 2012.

Palmisano, J.; Ramamurti, R.; Lu, K.-J.; Cohen, J.; Sandberg, W.; Ratna, B.; "Design of a biomimetic controlled-curvature robotic pectoral fin", IEEE International Conference on Robotics and Automation, 2007, pp. 966-973, Apr. 2007.

Ramamurti, R.; Geder, J.; Palmisano, J.; Ratna, B.; Sandberg, W.C.; "Computations of Flapping Flow Propulsion for UUV Design", Journal, 47th AIAA Aerospace Sciences Meeting Including the New Horizons Forum and Aerospace Exposition, Orlando, Florida, vol. 752, pp. 1-33, Jan. 5-6, 2009.

Ramamurti, R.; Geder, J.; Palmisano, J.; Ratna, B.; Sandberg, W.C.; "Computations of flapping flow propulsion for unmanned underwater vehicle design", AIAA journal, vol. 48, No. 1, pp. 188-201, Jan. 2010.

Ramamurti, R.; Geder, J.; Palmisano, J.; Preussner, M.; Ratna, B.; Sandberg, W.; "3-D Unsteady Computational Studies of a Four-Fin Bio-Inspired UUV", 17th International Symposium on Unmanned Untethered Submersible Technology, Aug. 2011, 10 pages.

International Search Report in corresponding application PCT/US2014/065932 dated Apr. 1, 2015.

* cited by examiner

ACTIVELY CONTROLLED CURVATURE ROBOTIC PECTORAL FIN

CROSS-REFERENCE TO RELATED APPLICATIONS

This application is a Division of application Ser. No. 13/987,921 filed on Sep. 17, 2013, the entire disclosure of which is incorporated by reference.

BACKGROUND

1. Technical Field

The present application relates to a fin used to generate propulsion and control forces for a vehicle in an underwater or water surface environment. More particularly, the instant application discloses a propulsion fin which can actively change its curvature during flapping stroke cycles and thus provides a single mechanism through which directional control over propulsive forces can be achieved.

2. Related Technology

The subject matter of this patent application disclosure has wide application to maritime propulsion, steering and direction control systems for underwater vehicles and vehicles which traverse surface waters.

Known methods of force production for propulsion and control of underwater and surface vehicles use rotating propellers, and/or rigid or passively deforming fins.

There are many undersea areas in which traditional propulsion and sensing techniques have proven effective for unmanned systems, but such undersea areas have mostly been in open waters.

Rotating propellers have limitations in force production at slow speeds and in highly dynamic environments where water flows are constantly changing. Additionally, a propeller on its own can only be used to propel a vehicle. It would require multiple non-coaxial propellers or a system of control surfaces for steering and directional control. Propellers also have disadvantages in certain environments as they are noisy, and can be adversely affected by interference of debris, such as near-shore vegetation.

Researchers seeking to improve on vehicle performance in cluttered undersea areas with fast changing currents and near-surface wave effects draw inspiration from fish and other aquatic organisms which inhabit these types of environments, where unmanned platforms could prove to be very useful. Combinations of finned propulsion and control surface actuation, and unique sensory systems provide these organisms the abilities they need to survive and thrive.

According to J. E. Colgate et al. "Mechanics and control of swimming: a review," IEEE Journal of Oceanic Engineering, vol. 29, pp. 660-673, July 2004 and J. C. Liao, "A review of fish swimming mechanics and behavior in altered flows," Philosophical Transactions of the Royal Society B. vol. 362 (1487), pp. 1973-1993, November 2007, a number of researchers have studied the fin force production mechanisms of fish. Several investigators have developed and adapted rigid and passively deforming robotic pectoral fins onto unmanned underwater vehicles (UUV's) including B. Hobson, et al. "PilotFish: Maximizing agility in an unmanned underwater vehicle," Proceedings of the International Symposium on Unmanned Untethered Submersible Technology, Durham, N.H., 1999; S. Licht, et al. "Design and projected performance of a flapping foil AUV," IEEE Journal of Oceanic Engineering, vol. 29, no. 3, 2004; P. Sitorus, et al. "Design and implementation of paired pectoral fins locomotion of labriform fish applied to a fish robot," Journal of Bionic Engineering, vol. 6, pp. 37-45, 2009; and N. Kato, et al., "Elastic pectoral fin actuators for biomimetic underwater vehicles," in Bio-mechanisms of Swimming and Flying, chap. 9, Springer Japan, 2008, pp. 271-282.

Other investigators have sought to develop actively controlled curvature pectoral fins including N. Kato, et al., "Elastic pectoral fin actuators for biomimetic underwater vehicles," in Bio-mechanisms of Swimming and Flying, chap. 9, Springer Japan, 2008, pp. 271-282; J. Palmisano, et al., "Design of a biomimetic controlled-curvature robotic pectoral fin," IEEE International Conference on Robotics and Automation, Rome, Itlay, 2007; K. W. Moored et al., "Investigating the thrust production of a myliobatoid-inspired oscillating wing," 3rd International CIMTEC Conference, Acireal, Italy, Jun. 8-13, 2008; and J. Tangorra et al., "The effect of fin ray flexural ridgidity on the propulsive forces generated by a biorobetic fish pectoral fin," The Journal of Experimental Biology, vol. 213, pp. 4043-4054, 2010.

Thus, rigid and passively deforming fins have a limitation in force production control, as there are fewer degrees of freedom which can be actuated, and thus less control over the direction of force production. Further, passively deforming fins generally require a trial-and-error method of determining shape deformation under loads.

A fin that can actively change its curvature during flapping stroke cycles provides a single mechanism through which directional control and through which propulsive forces can be achieved simultaneously. The instant invention provides a fin having an effector of propulsion and control that will not be damaged when operating in vegetation or other debris, such as in near shore environments where precise low-speed maneuvering is needed. It also enables greater control in flow-changing environments than traditional propellers and rigid/passive fins as the fin surface shape can be changed to take advantage of data involving a multitude of flow conditions. Therefore, the need exists for a fin that can actively change its curvature during flapping stroke cycles. Further, the need exists for a fin which provides a single mechanism through which directional control over propulsive forces can be achieved. In addition, the need exists for a fin which also provides an effector of propulsion and control that will not be damaged when operating in vegetation or other debris. Finally, the need exists for a fin which enables greater control in flow-changing environments contrasted with traditional propellers and rigid/passive fins as the fin surface shape can be changed to take advantage of a multitude of flow conditions.

SUMMARY OF THE INVENTION

An actively controlled curvature, robotic propulsion, and steering apparatus, having elements including: a motor housing containing a plurality of rib rotation motors, having connecting and motion transferring shafts, rib spars, and a plurality of ribs, mechanically movable and communicatively coupled to the plurality of rib rotation motors and connecting motor shafts, where the plurality of ribs includes a plurality of rib spars connected between the plurality of ribs and the plurality of rib rotation motors, rotationally coupled to and/or actuated by the plurality of rib rotation motors and connecting shafts. The actively controlled curvature, robotic propulsion, and steering apparatus further includes a flexible fin casing, within which the ribs reside, forming the complete actively controlled curvature robotic propulsion and steering apparatus. In addition, the actively controlled curvature robotic propulsion and steering apparatus can be characterized as a mechanical fin. The mechanical fin, further contains a plurality of control electronics circuits and a computer processor or a plurality of computer processors containing and/or programmed with actuation code when executed by the computer processor causing automated actuation propulsion and steering maneuverability of the actively controlled curvature robotic mechanical fin.

The computer processor and the plurality of control electronics circuits can be communicatively connected by a communication protocol over a communication network, to the mechanical fin. The computer processor and the plurality of control electronics circuits can be either residing in the mechanical fin or residing remotely and/or external to the mechanical fin, over either a direct data communications network connection or a remote wireless data communications network connection. The plurality of control electronics circuits can include at least an input device an output device, sensors, transducers, and/or keyboards.

The mechanical fin, when actuated, generates a plurality of gait propulsion forces and a plurality of directional steering forces, in various media including fluid, liquid and gaseous media, corresponding to a plurality of fin stroke amplitudes, a plurality of fin stroke frequencies and a plurality of fin rib deflections creating a plurality of velocity vectors including drag and thrust directional steering maneuverability vectors within the various media elements. Where the media can include liquids, such as water, oil, or a colloidal mixture of elements (including icy water), and air or other gases.

The plurality of fin rib deflections and the plurality of gait propulsion forces and the plurality of directional steering forces and the plurality of fin stroke amplitudes and the plurality of fin stroke frequencies cause the mechanical fin to actively change curvature and perform a continuous flapping motion simultaneously to operate in changing flow conditions of the various media.

Any number of the mechanical fin and/or fins forming a plurality of mechanical fins can be attached to a platform, forming a vehicle and actuation of the mechanical fin and/or the plurality of fins, when actuated by the executed code in the associated computer processor(s) cause the vehicle to maneuver and/or hover in the various media.

DETAILED DESCRIPTION

Figure 1:
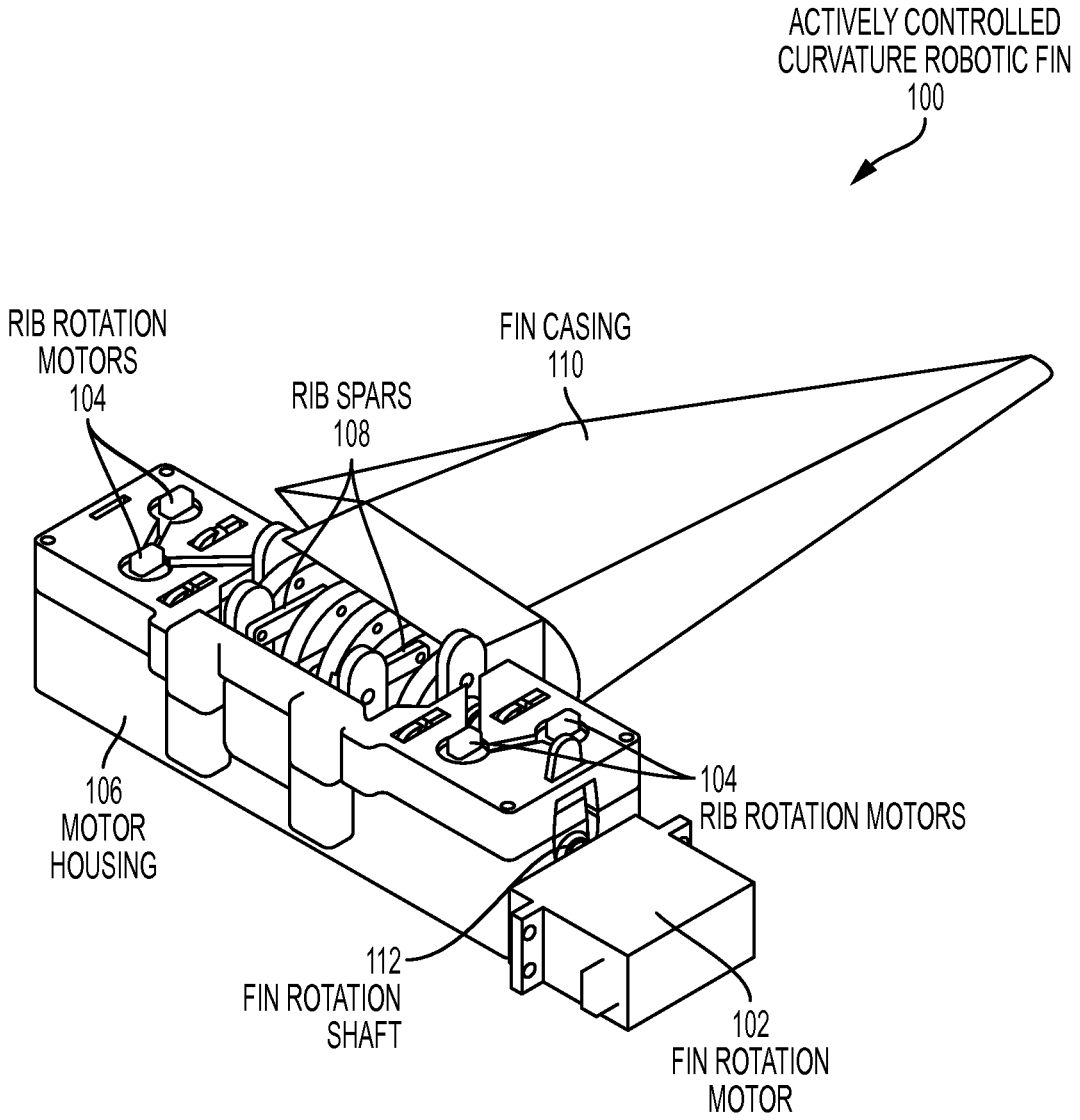
FIG. 1 illustrates an assembled, actively controlled curvature, robotic fin.

Preferred exemplary embodiments of the present invention are now described with reference to the figures, in which like reference numerals are generally used to indicate identical or functionally similar elements. While specific details of the preferred exemplary embodiments are discussed, it should be understood that this is done for illustrative purposes only. A person skilled in the relevant art will recognize that other configurations and arrangements can be used without departing from the spirit and scope of the preferred exemplary embodiments. It will also be apparent to a person skilled in the relevant art that the exemplary embodiments can also be employed in other applications. Further, the terms "a", "an", "first", "second" and "third" etc. used herein do not denote limitations of quantity, but rather denote the presence of one or more of the referenced items(s).

Figure 2:
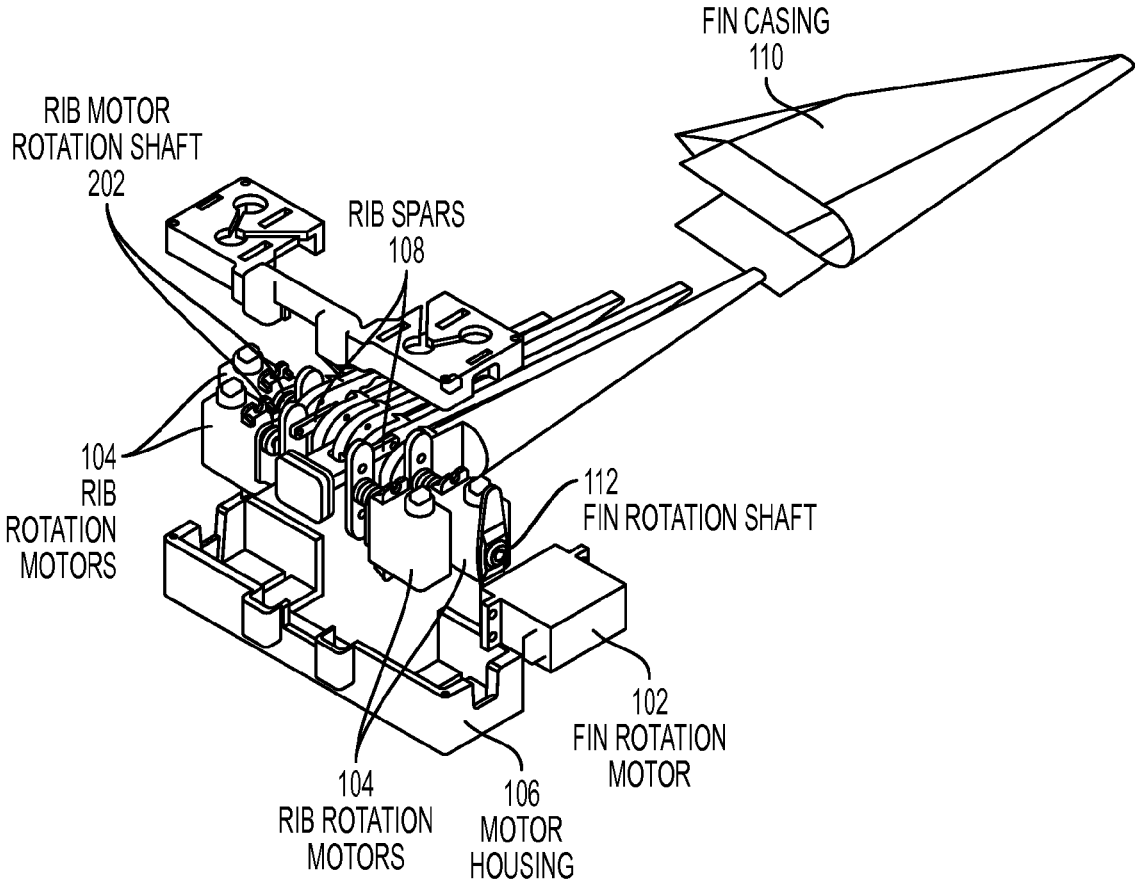
FIG. 2 illustrates an exploded view of the actively controlled curvature robotic fin, illustrated in FIG. 1.

The assembled actively controlled curvature robotic fin 100 is shown in FIG. 1. The exploded view of the actively controlled curvature robotic fin 100 is shown in FIG. 2. The actively controlled curvature robotic fin 100 consists of fin rotation motor(s) 104, rib rotation motor(s) 102, motor housing 106, rib spar(s) 108, ribs (including Rib 1, Rib 2, Rib 3, Rib 4, Rib 5) and fin casing 110.

Figure 3:
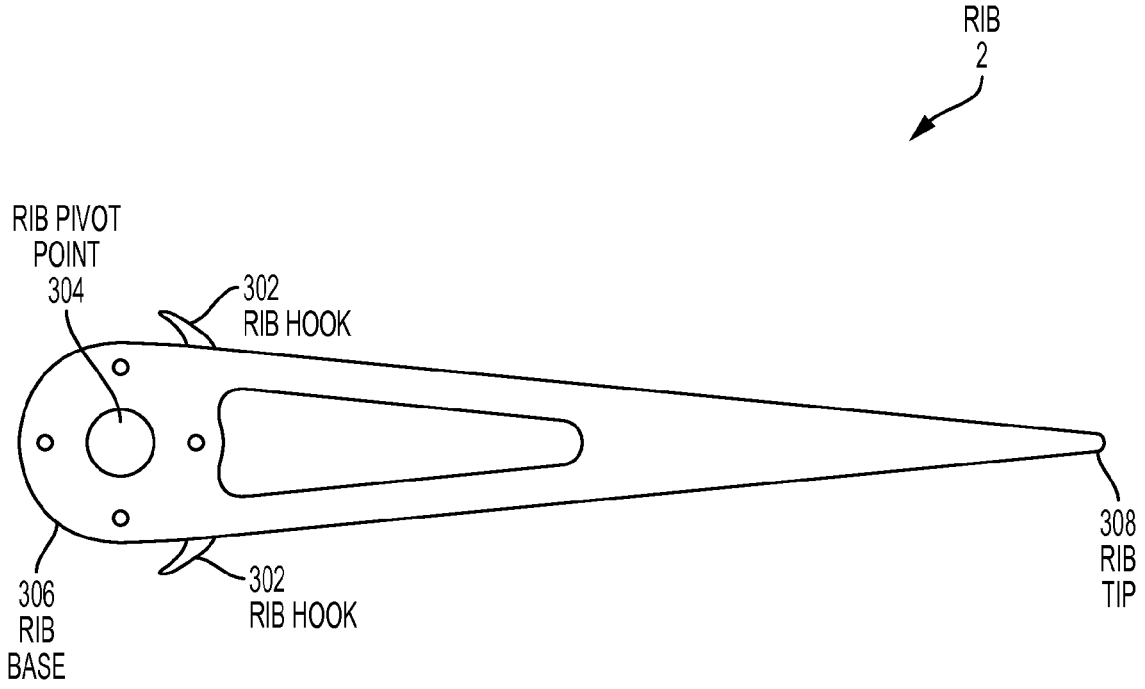
FIG. 3 illustrates an individual rib (RIB 2) of the actively controlled curvature robotic fin.

One of the rib spars 108 is shown in FIG. 3. The rib(s), such as Rib 2, have a tapered shape from rib base 306 to rib tip 308, and have a pivot point 304 near the rib base 306, and have rib hook(s) 302 built into the top and bottom of the rib (such as Rib 2), designed to attach the ribs (i.e., Rib 1, Rib 2, Rib 3, Rib 4, and Rib 5) to the fin casing 110, where the surface of the fin casing 110 is composed of flexible material, which can change shape to conform to the various deflections of the ribs, such as Rib 1, Rib 2, Rib 3, Rib 4, and/or Rib 5.

Figure 4A:
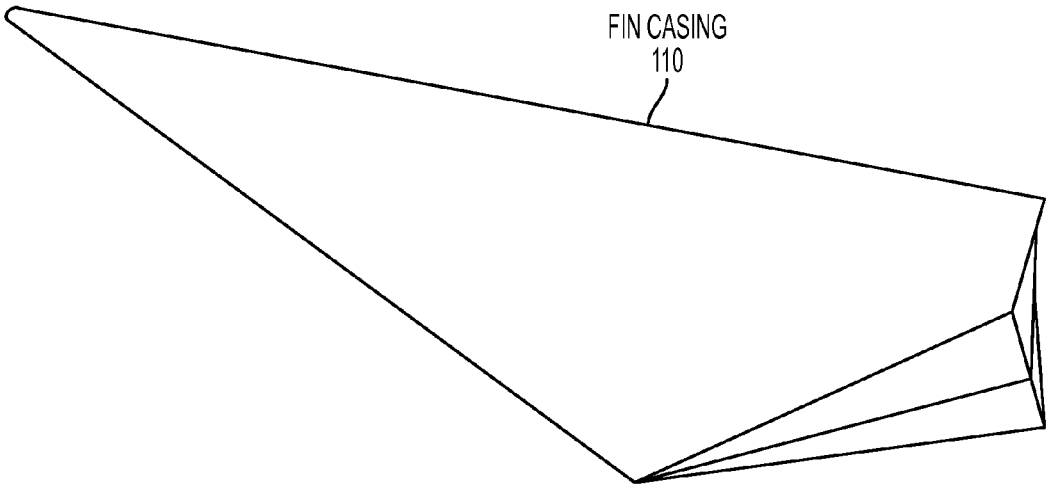
FIG. 4A illustrates a fin casing.
Figure 4B:
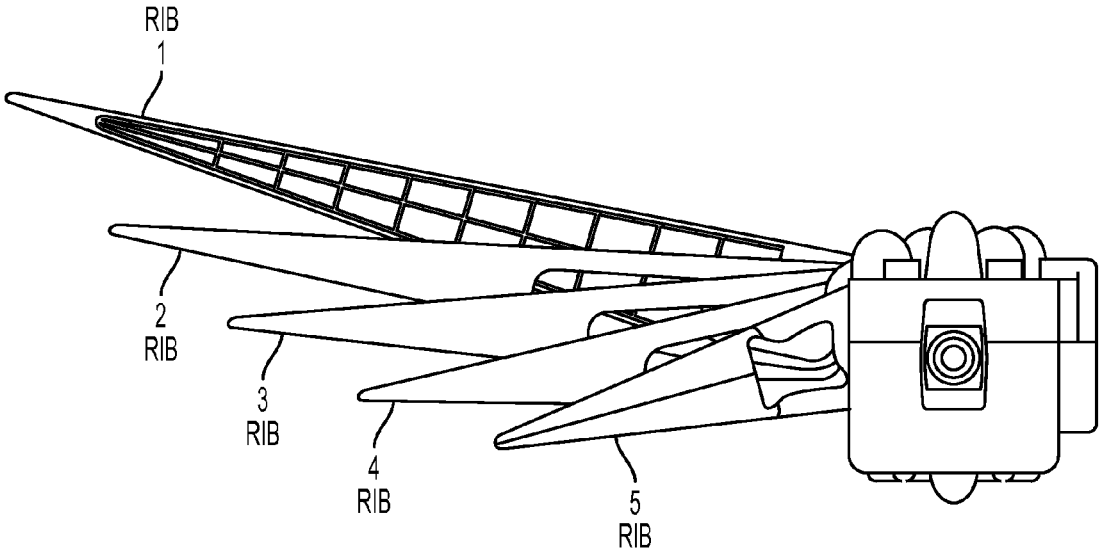
FIG. 4B illustrates an assemblage of a plurality of ribs within a motor housing. This configuration of the plurality of ribs is in conformance with the fin casing illustrated in FIG. 4A.

FIG. 4A illustrates the fin casing 110. Independent rib deflections (i.e., Rib 1, Rib 2, Rib 3, Rib 4, and Rib 5) are shown in FIG. 4B. Each of the rib spars 108 can be independently deflected to a different angle from the others, and these deflections define the shape of the fin casing 110 surface. Thus, FIG. 4B illustrates an assemblage of a plurality of rib spars 108 and ribs (i.e., Rib 1, Rib 2, Rib 3, Rib 4, and Rib 5) within the motor housing 106. This configuration of the plurality of rib spars is associated with a plurality of ribs, such as at least Rib 1, Rib 2, Rib 3, Rib 4, and Rib 5 and the number of ribs (i.e., Rib 1, Rib 2, Rib 3, Rib 4, and Rib 5) can include at least one or more ribs, (such as Rib 1, Rib 2, Rib 3, Rib 4, and Rib 5), limited only by the number of rib spars 108 configured within the motor housing 106 and the physical size of the motor housing 106. It is important to note the not all ribs have rib spars 108 attached; some ribs are connected directly to the rib rotation motor(s). Additionally, ribs (i.e., Rib 1, Rib 2, Rib 3, Rib 4, and Rib 5) can be any number of different sizes. A configuration of the plurality of rib spars 108 in FIG. 4B is in conformance with the fin casing 110 illustrated in FIG. 4A.

Referring to FIG. 1, FIG. 2, FIG. 3 and FIG. 4A, the motor housing 106 consists of two pieces which are pressed together and screwed down to clamp the rib rotation motors 104 in place. Additionally, a servo horn attached to the fin rotation shaft 112 of the fin rotation motor 102 is secured by the motor housing 106, when it is screwed down. The rotation shaft (i.e., the rib motor rotation shaft 202) of each rib rotation motor 104 connects to a single rib spar 108 via a servo horn at the rib pivot point 304. The rib spars 108 are aligned such that they all share the same rotation axis. All of the ribs (i.e., Rib 1, Rib 2, Rib 3, Rib 4, and Rib 5) are encased in the flexible fin casing 110, which attaches to rib hook(s) 302 at the base of each of the rib spars 108 near the motor housing 106. The exterior of the fin casing 110 (which is flexible) defines the surface of the fin casing 110 (see FIG. 4A and FIG. 4B), as the fin casing 110 conforms to the angle deflections of the plurality of ribs (i.e., Rib 1, Rib 2, Rib 3, Rib 4, and Rib 5) contained in the fin casing 110.

Actuation of the fin rotation motor 102 drives rotation of fins (such as the actively controlled curvature robotic fin 100) with control over fin stroke amplitude and fin stroke frequency. Actuation of each rib rotation motor 104 drives a rotation of a rib spar 108 about an axis parallel to a fin 100 rotation, of the actively controlled curvature robotic fin 100. The independent actuation of multiple rib rotation motors 104 enables independent angular deflections of the rib spars 108. The deflections of the ribs spars 108 deform the flexible fin casing 110 and serve to define the shape of the surface of the fin casing 110. This controlled fin 100 surface shape is defined as the fin 100 curvature of the actively controlled curvature robotic fin 100.

A combination of fin 100 rotation and rib rotation actuation (and thus fin 100 stroke amplitude, stroke frequency, and curvature control) provides control over the fin 100 shape over the course of a fin 100 stroke. This controllable shape-time history enables control over the magnitude and direction of fin 100 generated forces in a fluid or gas medium, such as water. Mounting one or multiple fins 100 on a vehicle in an underwater or water surface environment enables precise vectoring of propulsion and control forces for platform vehicle 780 maneuvering.

The actively controlled curvature robotic fin 100 has advantages over rotating propellers and passively deforming fins in force control, especially in dynamic, flow-changing environments (flow conditions data 711). Controlling the fin 100 surface curvature during a fin 100 stroke allows controlled vectoring of fin 100 forces which provides an advantage in generating control forces (maneuvering vector force data 712). Additionally, a controlled shape-changing fin 100 can take advantage of the changing flow fields to provide more reliable propulsion forces at slow speeds and in flow-changing environments (flow conditions data 711). The actively controlled curvature robotic fin 100 may have an additional advantage over rotating propellers in dealing with debris such as near-shore vegetation, in that the actively controlled curvature robotic fin 100 may likely not get stuck or tangled in debris objects, as easily as conventional propulsion devices.

In a first exemplary embodiment, new features of the actively controlled curvature robotic fin 100 include the presence and use of actuated fin ribs within a fin 100, individual rotational actuation of each fin rib (i.e., Rib 1, Rib 2, Rib 3, Rib 4, and Rib 5) enabling variable deflections between the ribs (i.e., Rib 1, Rib 2, Rib 3, Rib 4, and Rib 5), a flexible fin casing 110 provides the fin 100 surface to the fins whose curvature is actively controlled by the motion of the fin ribs, and also, provides a compact and easy to assemble housing for the of rib actuators.

In a second exemplary embodiment, the ribs (i.e., Rib 1, Rib 2, Rib 3, Rib 4, and Rib 5) of the actively controlled curvature robotic fin 100 can be either rigid or compliant (flexible) structural members and can be actuated using direct angular rotation or through bending of the compliant structure. In addition to hooks, the method of attaching the fin casing 110 to the ribs (i.e., Rib 1, Rib 2, Rib 3, Rib 4, and Rib 5) can include but are not limited to: adhesives, hook-and-loop fasteners, and buttons.

Tests for force production measurements and kinematics measurement, (i.e., kinematics algorithms (A3) to include forward gait; reverse gait; upward gait; downward gait; and kinematics interpolate) are used to validate fin propulsion effectiveness. Algorithm unit 730 can contain control algorithms, and command algorithms, as well as kinematics algorithms such as in algorithms A1, A2, A3 through An, where A1 is a control algorithm, A2 is a command algorithm and A3 is a kinematics algorithm.

Figure 7:
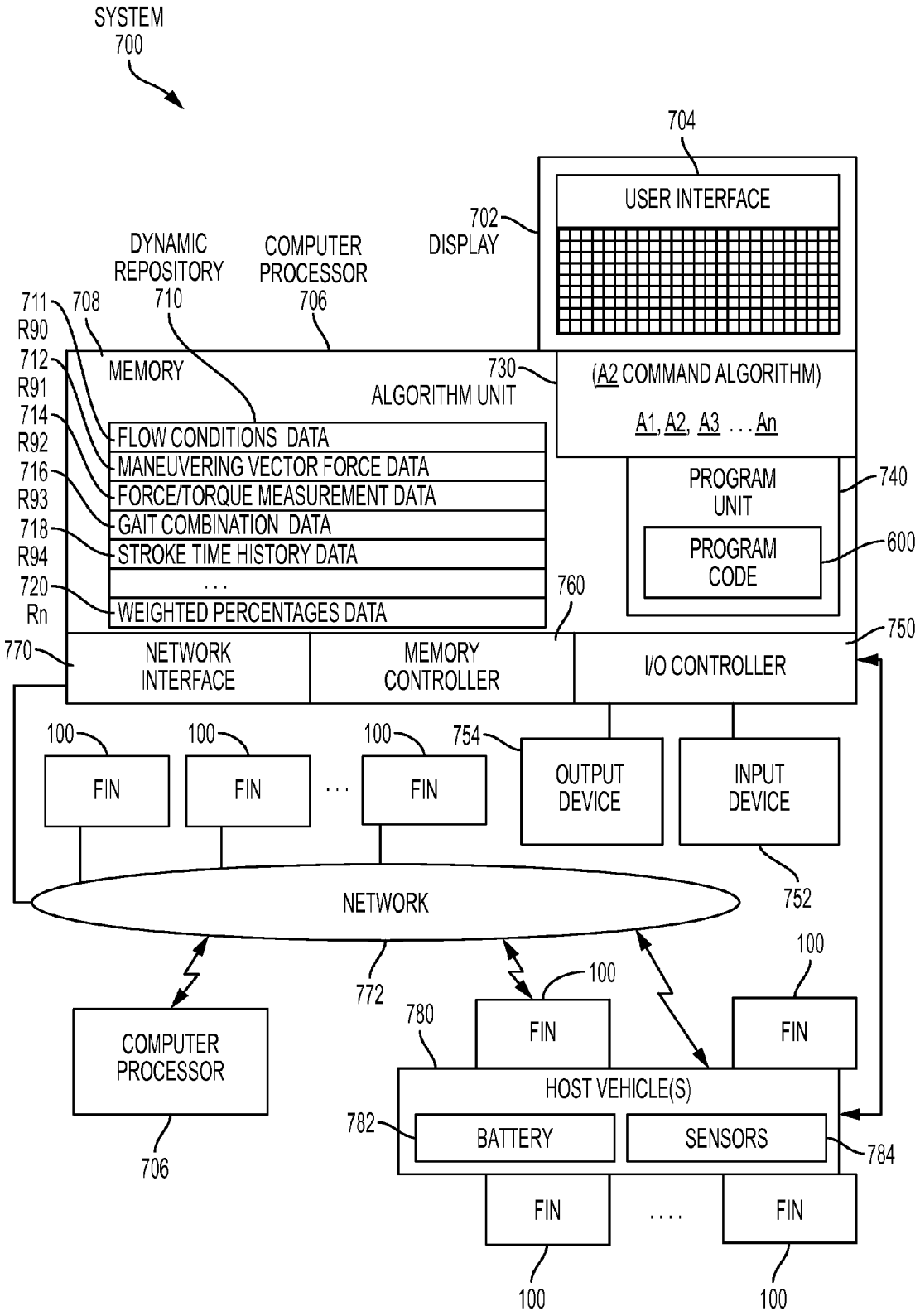
FIG. 7 illustrates a schematic of automated microcontrollers, computers and computer processors, in conjunction with proprietary control software and proprietary software drivers associated with control electronics circuits in the actively controlled curvature robotic fin 100, which cause the control electronics to actuate rib (i.e., Rib 1, Rib 2, Rib 3, Rib 4, and Rib 5) motions.

Referring to FIG. 7, proprietary control software and proprietary software drivers operating in conjunction with automated microcontrollers, computers and computer processors (such as computer processor 706) associated with control electronics circuits in the actively controlled curvature robotic fin 100 cause the control electronics to actuate rib (i.e., Rib 1, Rib 2, Rib 3, Rib 4, and Rib 5) motions. The computers, computer processors (such as computer processor 706) and associated control electronics can be either and/or resident in and/or on the actively controlled curvature robotic fin 100 and/or resident in a location remote from the actively controlled curvature robotic fin 100 and where the computers, computer processors (such as computer processor 706), and associated control electronics can be either communicatively coupled to the actively controlled curvature robotic fin 100 over a communications network 772, including hard wired or wireless communications networks including data communications facilities. The software includes algorithms (such as algorithms A1 through An) and other program code (such as program code 600), and memory 708 associated with repository 710 contains data (represented by R90 through R94 and Rn) accessible to the program code 600 and/or algorithms.

Figure 5:
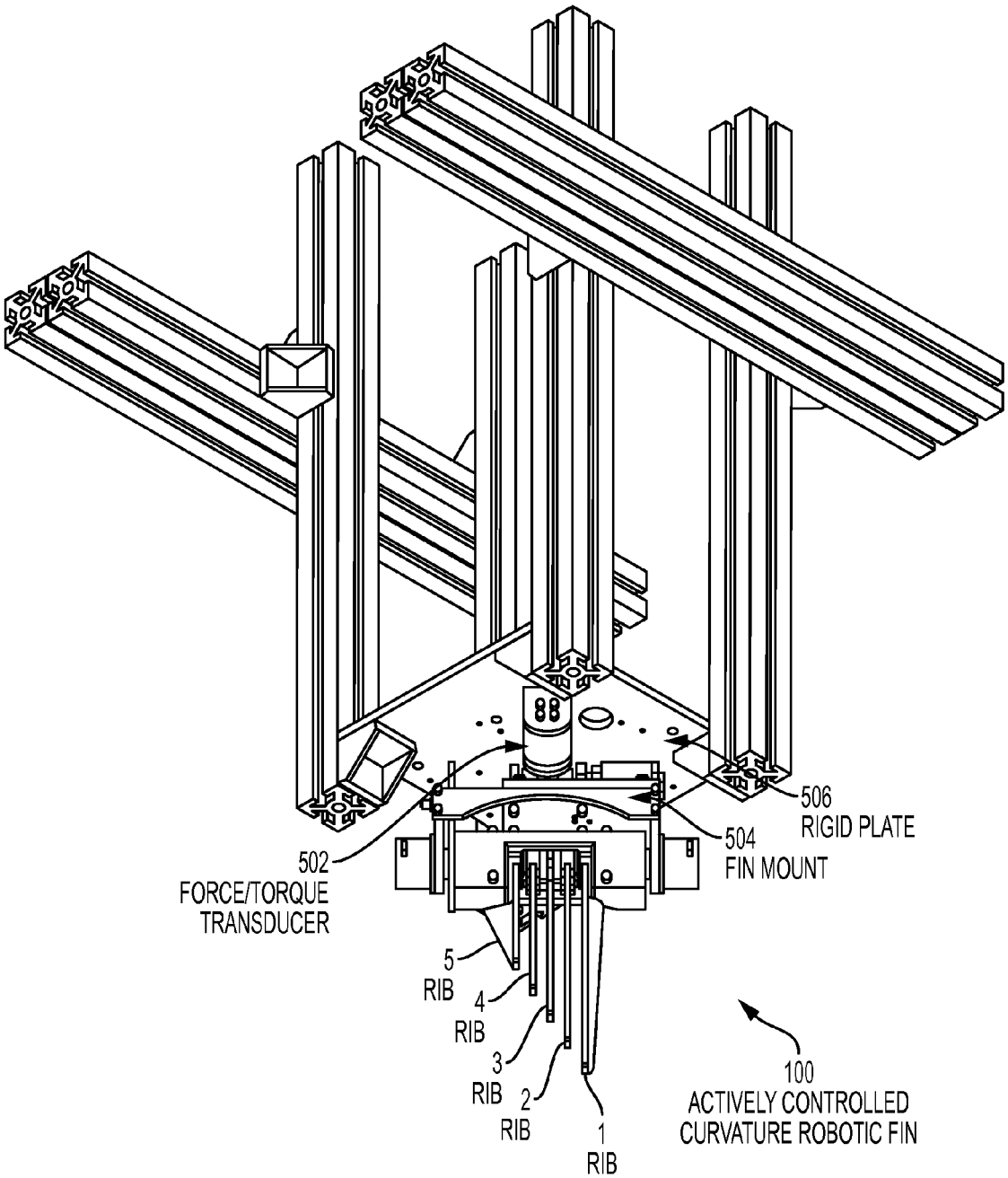
FIG. 5 illustrates a fin force test stand including a fin mount, and a fin mounted on the fin mount and a force/torque transducer.

Referring to FIG. 5, fin 100 force measurements were made by mounting an assembled actively controlled curvature robotic fin 100 to a rigid plate 506 attached to a force and torque transducer 502. Force/Torque measurements data 714 were divided by the effective moment arm, the distance from the force/torque transducer 502 to the center of pressure on the actively controlled curvature robotic fin 100. The time histories data of force measurements validated the thrust, lift and drag production of the actively controlled curvature robotic fin 100, where the thrust and/or drag can be produced by either one or more of a fin 100 gait, i.e., fin 100 stroke amplitude or rib deflections within the fin causing 110 a rippling movement of the fin 100, corresponding to motion vectors and/or stability vectors compensating for external vector forces, corresponding to a float and/or relative stationary position (hover).

Figure 9:
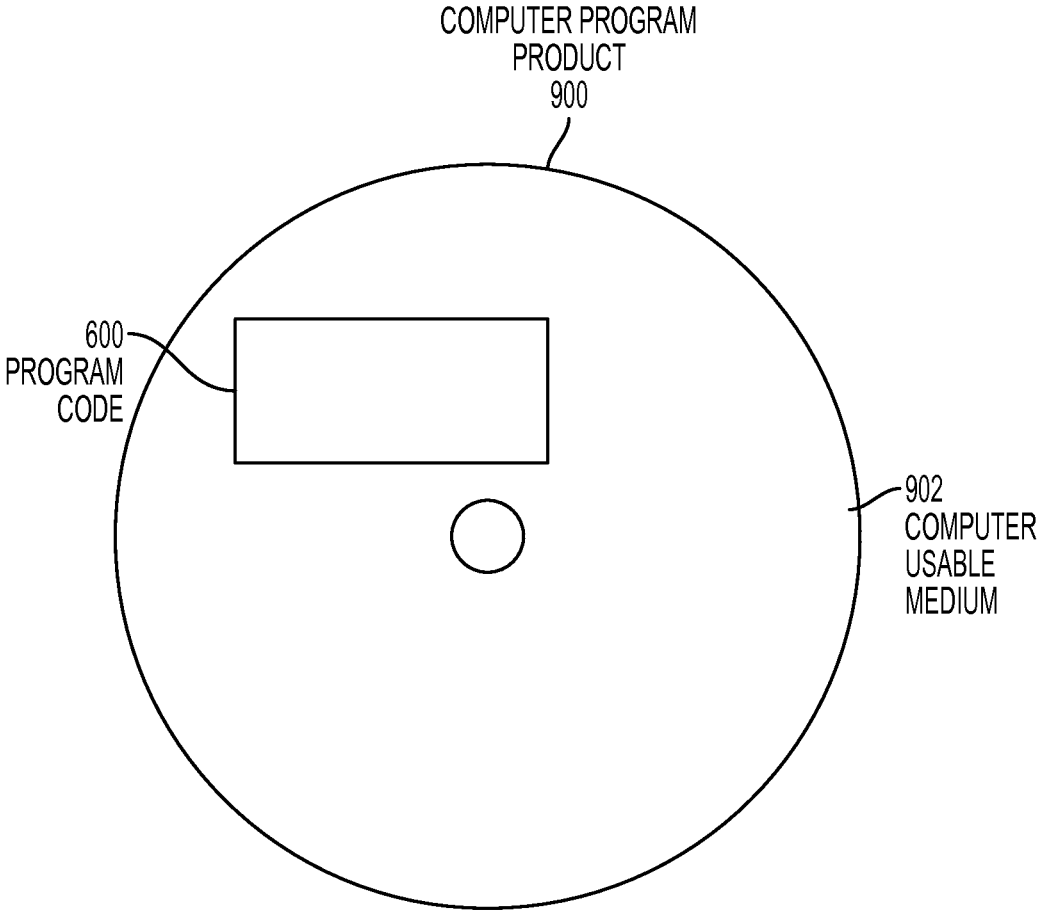
FIG. 9 illustrates an exemplary computer readable and computer executable medium containing a computer program product including method operations included in program code executed on a system, implementing robotic fin actuation in platform vehicle.

Referring to FIG. 1, FIG. 6, FIG. 7, and FIG. 9 (where FIG. 9 illustrates an exemplary computer readable and computer executable medium 902 containing a computer program product 900 including method operations included in program code 600 executed on a system 700, implementing robotic fin 100 actuation in platform vehicle 780.

The time history of fin 100 curvature, defined as the curvature profile over a single fin 100 flap, is defined by the time histories of the individual rib rotation angles within that actively controlled curvature robotic fin 100. Combined with the time history of the fin 100 rotation angle, this defines the kinematics for the fin 100. Smooth rib and fin 100 rotation time histories are achieved by commanding key servo rotation points for each individual rib and fin 100 servo throughout the fin 100 stroke, and then interpolating between these points to achieve the desired rotation angles throughout the stroke (in other words, interpolates between predefined angular positions to determine a position at an intermediate time). A snippet of a program code 600 including the functions for defining actively controlled curvature robotic fin 100 kinematics is included below (this exemplary version of the program code 600 is not limited and exhaustive of the types of methods of actuation that can be implemented in program code. Various changes in form and details of the program code can be made without departing from the spirit and scope of the invention; thus, adaptations and modifications of the program code, as well as other aspects of the specific embodiments adopted by others by applying knowledge within the skill of the art, may be performed without departing from the general concept of the exemplary embodiments of the invention. Therefore, such adaptations and modifications are intended to be within the meaning and range of equivalents of the disclosed embodiments. In the program code 600, for each gait definition, a unique row vector is defined for each servo, and each row vector defines that servo's positions over time:

```
Program Code 600:
//define forward gait
int8_t forward_gait[servos_per_fin][positions] = {
    {-100,-100,100,100,100,100,-100,-100},
    {-50,-50,50,50,50,50,-50,-50},
    {50,50,-50,-50,-50,-50,50,50},
    {100,100,-100,-100,-100,-100,100,100},
    {0,71,100,71,0,-71,-100,-71}};
//define reverse gait
int8_t reverse_gait[servos_per_fin][positions] = {
    {-50,-100,-50,0,50,100,50,0},
    {0,-50,-100,-50,0,50,100,50},
    {50,0,-50,-100,-50,0,50,100},
    {100,50,0,-50,-100,-50,0,50},
    {0,-71,-100,-71, 0,71,100,71}};
//define lift/up gait
int8_t upward_gait[servos_per_fin][positions] = {
    {100,-28,-28,-28,-68,-68,-20,60},
    {-26,-10,-2,-2,-30,-30,-38,-54},
    {-54,10,2,2,30,30,14,-26},
    {36,16,12,8,48,48,52,76},
    {-60,-58,-49,-31,-2,35,72,94}};
//define lift/down gait
int8_t downward_gait[servos_per_fin][positions] = {
    {-100,28,28,28,68,68,20,-60},
    {26,10,2,2,30,30,38,54},
    {54,-10,-2,-2,-30,-30,-14,26},
    {-36,-16,-12,-8,-48,-48,-52,-76},
    {60,58,49,31,2,-35,-72,-94}};
//define demo gait
int8_t demo_gait[servos_per_fin][positions] = {
    {-100,-50,100,100,100,50,-100,-100},
    {-50,-50,50,50,50,50,-50,-50},
    {50,50,-50,-50,-50,-50,50,50},
    {100,100,-100,-100,-100,-100,100,100},
    {0,71,100,71,0,-71,-100,-71}};
//define home (centered) gait
int8_t home_gait[servos_per_fin][positions] = {
    {0,0,0,0,0,0,0,0},
    {0,0,0,0,0,0,0,0},
    {0,0,0,0,0,0,0,0},
    {0,0,0,0,0,0,0,0},
    {0,0,0,0,0,0,0,0}};
//decides which gait to run
int8_t kinematics_interpolate(uint8_t gait, float pcurrent, uint8_t pnext,
uint8_t i)
    {
    int8_t val1;
    int8_t val2;
    if(gait==NONE)
        return 0;
    else if(gait==FORWARD)
        {
        val1=forward_gait[i][(uint8_t)pcurrent];
        val2=forward_gait[i][pnext];
        }
    else if(gait==REVERSE)
        {
            val1=reverse_gait[i][(uint8_t)pcurrent];
            val2=reverse_gait[i][pnext];
            }
        else if(gait==LIFT)
            {
            val1=upward_gait[i][(uint8_t)pcurrent];
            val2=upward_gait[i][pnext];
            }
        else if(gait==DOWN)
            {
```

-continued

```
                val1=downward__gait[i][(uint8__t)pcurrent];
                val2=downward__gait[i][pnext];
                }
        else if(gait==DEMO)
                {
                val1=demo__gait[i][(uint8__t)pcurrent];
                val2=demo__gait[i][pnext];
                }
        else if(gait==HOME)
                {
                val1=home__gait[i][(uint8__t)pcurrent];
                val2=home__gait[i][pnext];
                }
        return interpolatef(fmod(pcurrent,1), 0, 1, val1, val2);
        }
    //calculates and interpolates kinematics
    void kinematics__calculate(uint8__t fin__gait[ ], float pcurrent, uint8__t
pnext)
        {
        for(int i=0; i<servos__per__fin; i++)//cycle through each servo
                {
                rib__position[FL][i] =
                        (kinematics__interpolate(fin__gait[0],pcurrent,pnext,i)
                //make sure fits within servo movement
                if(amplification[FL] < 0)
                        amplification[FL]=0;
                if(amplification[FL] > 1)
                        amplification[FL]=1;
                //interpolate gait to match servo range, and factor in
amplification
    rib__position[FL][i] = interpolate((int8__t)rib__position[FL][i], −100, 100,...
DRIVE__SPEED__MIN*amplification[FL],...
                        DRIVE__SPEED__MAX*amplification[FL]);
                }
        }
    //runs the kinematics based on a timer
    void kinematics(void)
        {
        //--------- start TIME PASSED CALCULATOR
        //get time passed
        t__stroke__end = clockGetus( );
        t__stroke__time__passed = t__stroke__end − t__stroke__start;
        //if timer goes over allowed time in stroke, reset
        if(t__stroke__time__passed > time__per__stroke__us)
                {
                t__stroke__time__passed −= time__per__stroke__us;//determine
time that it went over
                t__stroke__start = clockGetus( )−t__stroke__time__passed;//reset
timer
                }
        //--------- end TIME PASSED CALCULATOR
        //--------- start DETERMINE ARRAY POSITION
        //determine position in kinematics to use, given current time
passed
    float position__current = interpolatef(t__stroke__time__passed, 0,
time__per__stroke__us,...
                                0, positions);
        //calculate the next position
        uint8__t position__next = position__current +1;
        if(position__next>(positions−1))
                position__next=0;
        //--------- end DETERMINE ARRAY POSITION
        //--------- start CALCULATE KINEMATICS
        kinematics__calculate(FL__gait,FL,position__current,position__next);
        //--------- end CALCULATE KINEMATICS
        //--------- start MBAB
        rib__position[FL][bulk]=interpolate(rib__position[FL][bulk],DRIVE__SPE
ED__MIN,...
    DRIVE__SPEED__MAX,min__bulk__LF,max__bulk__LF);
        //--------- end MBAB
        //--------- start Sending final commands to servos
        act__setSpeed(&rib1__FL,rib__position[FL][rib1]);
        act__setSpeed(&rib2__FL,rib__position[FL][rib2]);
        act__setSpeed(&rib4__FL,rib__position[FL][rib4]);
        act__setSpeed(&rib5__FL,rib__position[FL][rib5]);
        act__setSpeed(&bulk__FLf,rib__position[FL][bulk]);
        act__setSpeed(&bulk__FLr,rib__position[FL][bulk]);
        }
```

-continued

```
Where int = integer
Where val = value
Where FL = forward left
Where pcurrent = position_current
Where pnext = position_next
Where MBAB = mean bulk angle bias, and
Where a library of C-code functions called "WebbotLib is used
which defines various functions, such as "act_setSpeed",
```

Figure 6:
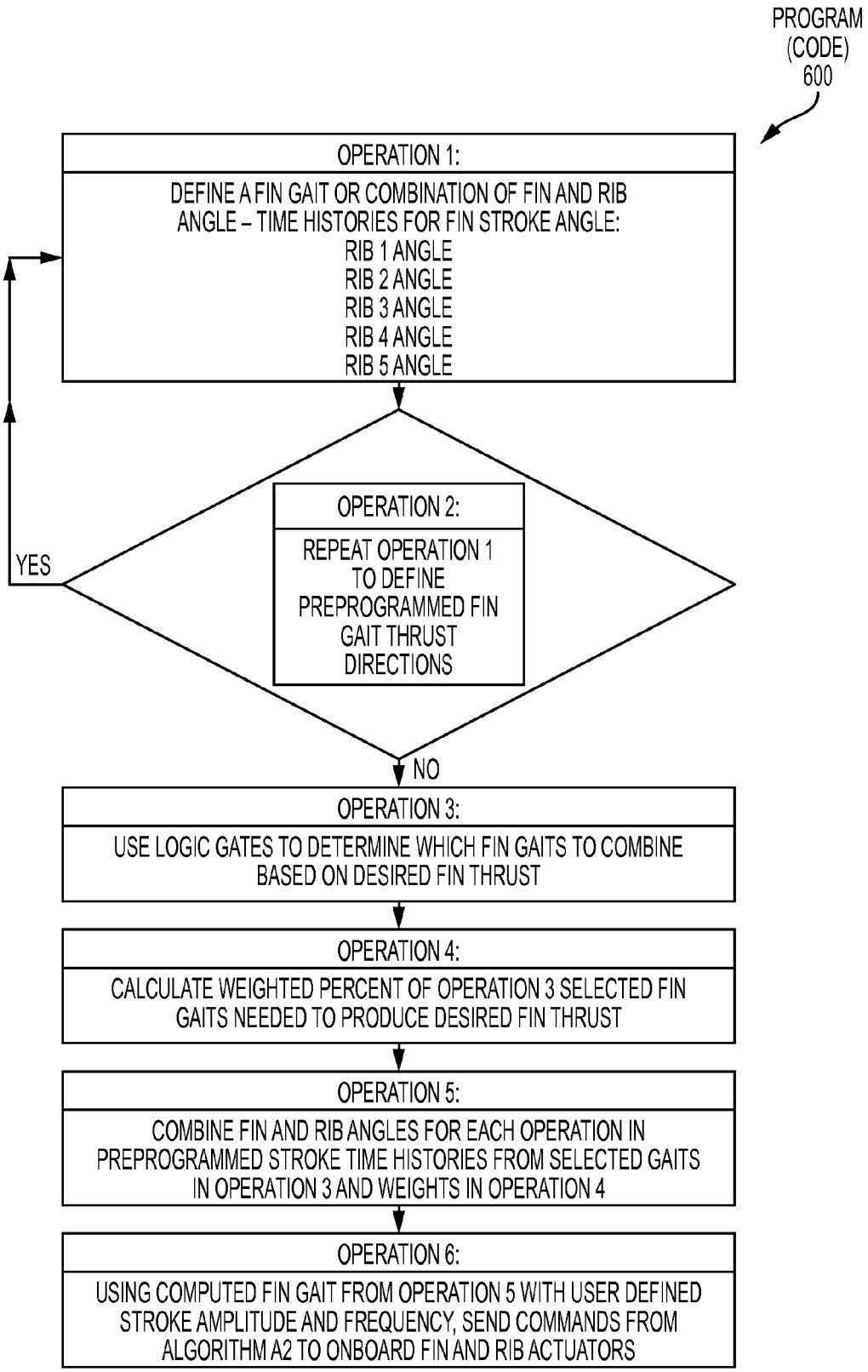
FIG. 6 illustrates operations defining the kinematics for each fin of a plurality of fins.

Referring to FIG. 6, the process of defining the kinematics for each actively controlled curvature robotic fin 100 represented by the above program code 600 includes the following operations:

A first operation (operation 1) defines a fin 100 gait, or combination of fin 100 and rib angle-time histories, by determining fin 100 stroke angle(s) for rib 1, rib 2, rib 4, rib 5 and/or any number of ribs utilized.

A second operation (operation 2), or sub-operation, repeats the first operation above to define preprogrammed fin gaits which produce thrust in desired directions.

In a third operation (operation 3), logic gates are used to determine which fin gaits to combine (gait combination data 716), based on desired fin thrust.

In a fourth operation (operation 4), weighted percentages (weighted percentages data 720) are calculated for the determined and selected fin gaits which are to be combined, in order to produce the desired fin 100 thrust.

In a fifth operation (operation 5), fin angles and rib angles are combined for each operation in the preprogrammed stroke time histories (stroke time history data 718) from the selected gaits determined in the above third operation (operation 3) and the weighted percentages (weighted percentages data 720) calculated from the above fourth operation (operation 4); and In a sixth operation (operation 6), based on fin 100 gait, computed from the above operation 5 and also in conjunction with defined stroke amplitude and frequency, commands are generated and sent to onboard fin 100 actuators and rib actuators.

The fin(s) 100 (i.e., the robotic fin(s) 100) can be incorporated into unmanned underwater vehicle(s) 780 (UUV's), where the UUV is propelled by a plurality of fin(s) 100; in a third exemplary embodiment, the UUV vehicle 780 can be propelled by at least four fin(s) 100. In other embodiments, the vehicle 780 can be propelled by at least one fin 100. UUV models are validated by comparing open-loop simulated responses (using computational fluid dynamics) with the experimentally measured responses to fin thrust and lift inputs. Closed-loop control algorithms (feedback control algorithms), which command changes in fin kinematics, are tested on the UUV and validate fin 100 and UUV models and demonstrate precise maneuvering capabilities of the actively controlled curvature robotic pectoral fin 100.

Vehicle 780 hardware control and computations are performed by a 16 MHz A T MEGA 2560 microcontroller.

Vehicle 780 can range in length from about 0.40 meters to about 2 meters having an ideal length of about 1.01 meters.

Figure 8:
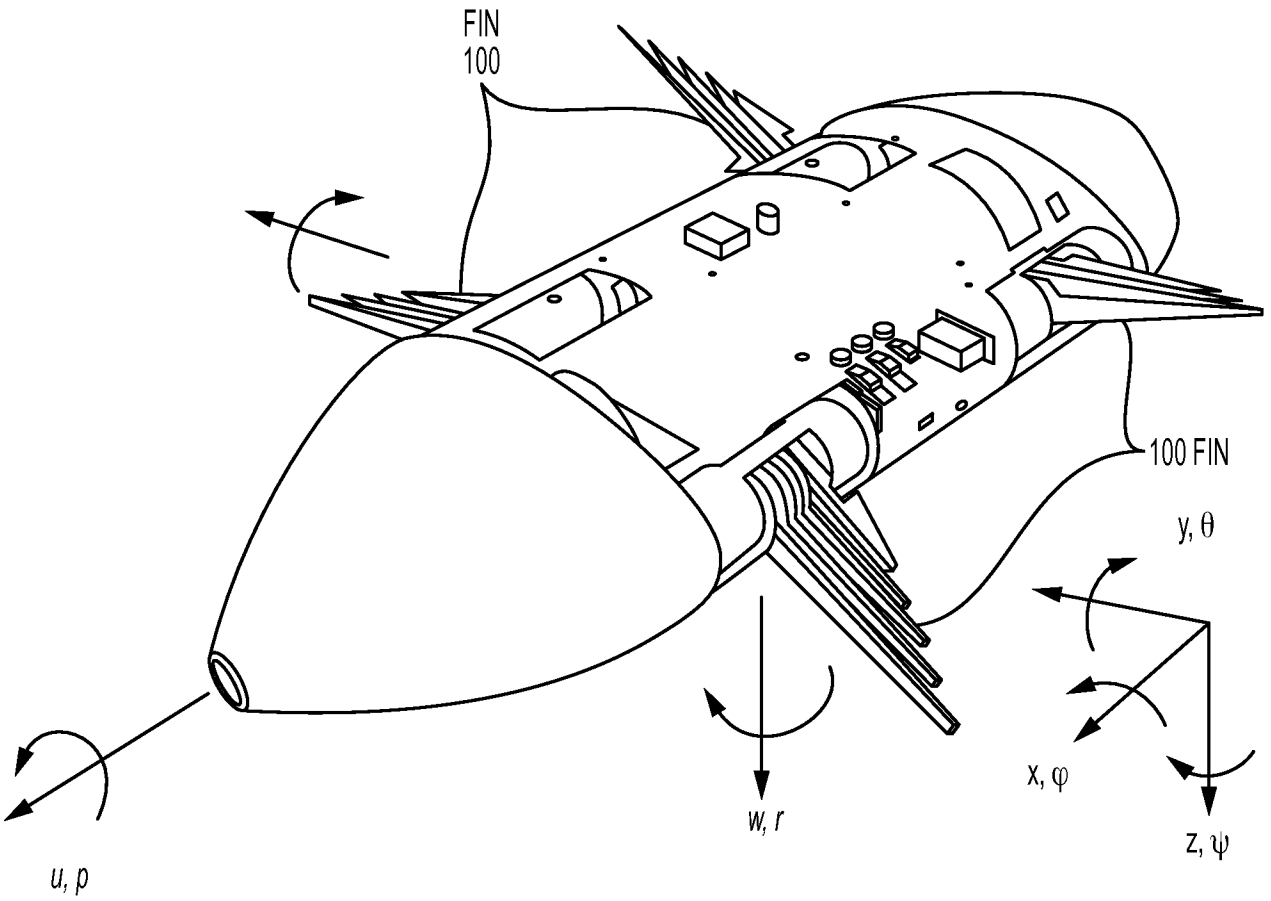
FIG. 8 illustrates coordinate inertial reference frames of a robotic fish vehicle.

Referring to FIG. 7 and FIG. 8, where FIG. 8 shows coordinate reference frames of vehicle 780. The vehicle 780 employs a water-tight cylinder for housing lithium batteries including lithium and other types of batteries (such as battery 782); control electronics, sensors, and inertial measurement units (IMUs) including: a three-axis gyro, a three-axis accelerometer and compass.

Referring to FIG. 8, the fin 100 mounts and housings are designed to reduce drag by minimizing cross-flow through the vehicle hull. The flooded, fiberglass molded nose, middle, and tail sections are currently reserved for additional payloads and sensors 784. Optimization of the performance of vehicle 780 allows minimization of (i.e., reduced) power requirements.

The rigid body hull of vehicle 780 is modeled separately from the elastic bending and twisting of the fin(s) 100. The rigid body hull of vehicle 780 is based on six degree-of-freedom (6-DOF) translational and rotational equations. The vehicle 780 hull is symmetric about the x-z and y-z planes, and although it is not symmetric about the x-y plane; according to W. Wang et al. "Modeling and simulation of the VideoRay ProIII underwater vehicle," MTS OCEANS Conference, May 2007, it is assumed to be symmetric because it operates at low-speeds. Thus, because of vehicle 780 symmetry and low speed operation, lift forces on the body become negligible.

The rigid body mass terms of the vehicle 780 were calculated from CAD models and physical measurements of the vehicle 780. Drag terms were computed in computational fluid dynamics simulations and showed that the linear terms were negligible along and about all axes.

Referring to FIG. 8, the actively controlled curvature fin(s) 100 are mounted to the rigid body of the vehicle 780, such that fin 100 thrust acts along the body x-axis and fin 100 lift acts along the body z-axis. Fin 100 force generation along the body y-axis is negligible, because the differential in the force produced by the left side fin(s) 100 with the right side fin(s) 100 is close to zero in this direction.

Fin 100 thrust is characterized as (IT); and fin 100 lift is characterized as (fL). LF, LB, RF and RB identify the left front, left back, right front, and right back of fin(s) 100, respectively. The x-position of the center of pressure on the fin(s) 100 is denoted by XF for the front fin(s) 100 and XB for the back fin(s) 100. The y-position of the center of pressure on the fin(s) 100 is denoted by YL for the left fin(s) 100 and YR for the right fin(s) 100. The center of pressure defines the location of the fin 100 generated forces which is needed to compute the fin 100 generated moments, and was determined in computational fluid dynamics (CFD) simulations.

CFD computed thrust time history for fin 100 forward gait kinematics using experimental forward gait kinematics at 1.8 Hz flapping frequency derived an average thrust of 1.76 Newtons, achieved an improved force generation, even when considering that vehicle 780 fin 100 thrust decreases linearly with free stream flow speed in the regime of flow speeds the vehicle experiences. Fin 100 kinematics selection and fin 100 force production characterization is an active area of research, and the fin 100 model continues to be updated as these fin 100 studies produce results. More detailed studies of fin 100 kinematics including curvature time histories, and flapping frequency and amplitude will lead to improved fin

100 thrust and lift performances, which in turn will lead to improved vehicle 780 performance, as well as a more refined fin 100 model.

Heave Performance: experimental results demonstrate a steady-state vehicle 780 heave rate of 3.3 cm/s.

Yaw Performance: An expected magnitude of average thrust from each of the four fin(s) 100 is 0.7 Newtons. Experimental results demonstrate a steady-state yaw rate of 41 degrees/second.

While validation of the 6-degrees of freedom vehicle 780 dynamics model is not complete using only analysis of experimental heave and yaw data, it does validate the methods by which vehicle 780 dynamics coefficients are calculated. The rigid body mass, added mass, and drag coefficients validated through heave and yaw experiments are computed using equations and tools as the coefficients describing other vehicle 780 modes of motion.

Closed loop maneuvering performance: Closed loop control performance for simple maneuvers is analyzed in simulation and experiments. Vehicle 780 control is achieved by combining preprogrammed fin 100 gaits to alter the fin 100 kinematics and vector thrust in a direction to produce desired vehicle 780 motion.

Depth control: Feedback of vehicle 780 depth through a pressure transducer (SSI TECHNOLOGIES P51) provides the primary source of state information for vehicle 780 depth control. Fin 100 bias is controlled as a function of depth, pitch rate and angle, and roll rate and angle. As the vehicle 780 has sufficient natural damping in heave, feedback of depth rate is not needed. A gain constant is denoted by value K for a given subscripted state variable. In a dive maneuver, pitch and roll stability are ensured while depth is controlled to a commanded value. Simulated performance of the vehicle 780 is a simple depth change maneuver (moving vertically through a column of water) and is compared with experimental results. In simulated and experimental depth maneuvers, the vehicle 780 completes a 40 cm dive in 14 seconds. The simulated depth matches the experimental depth with an average error of 0.7 cm during the dive maneuver. However, during resurfacing (after 14 seconds), the simulation and the experiment diverge, leading to a depth error of 15 cm, after 16 seconds of the dive maneuver. Explanation for this error includes changes in vehicle 780 buoyancy, attributed to pockets of air within the wetted hull, and shifting of mass within the vehicle 780 electronics housing leading to fin 100 bias angle saturation to maintain pitch and roll stability, as associated with mean bulk angle bias (MBAB).

Heading control: Feedback of vehicle 780 heading through a magnetic compass and yaw rate through a gyro provide the primary sources of state information for vehicle 780 heading control. According to P. Sitorus et al., "Design and implementation of paired pectoral fins locomotion of labriform fish applied to a fish robot," Journal of Bionic Engineering, vol. 6, pp. 37-45, 2009, fin 100 curvature is controlled as a function of forward speed, and yaw rate and angle. While vehicle 780 position in the x-y plane would normally also drive fin 100 curvature, the vehicle 780 currently does not have an accurate positioning system in this plane. Simulated performance of the vehicle 780 in a simple yaw maneuver (in hover) is in agreement with experimental results. An 180 degree turn is completed in 6 seconds in both simulation and experiment. During the entire 180 degree heading change and steady-state oscillation, the average error between simulation and experiment is 16 degrees. (An explanation for this error includes interference in compass heading measurements due to magnetic field disturbances in the laboratory environment). Improved performance has been achieved in the heading control algorithm, based on validation of the feedback controller for heading, such as adding yaw rate feedback, which dampens oscillations in heading control response.

Vehicle 780 operates at a forward speed surge rate from about zero (0) meters per second (m/s) and/or zero (0) knots up to a maximum of about 1.2 m/s and/or 2.3 knots. Operating in a range between 2 and 3 knots enables much greater position holding capability and vehicle 780 control in shallow water areas.

Vehicle 780 maximum heave rate ranges from about 3.1 cm/s up to about 3.8 cm/s.

Vehicle 780 maximum yaw rate ranges from about 37 degrees/second up to about 41 degrees/s.

Proportional-integral-derivative (PID) control of fin 100 parameters is sufficient for quick and accurate simple propulsion and/or control maneuvers achieving a highly maneuverable UUV vehicle 780. Even though fin(s) 100 have demonstrated the capability to vector thrust in multiple directions through changes to curvature and stroke bias angle, values for these fin 100 parameters, such as fin 100 kinematics of gait optimization for maximum thrust and lift are being improved so as to achieve greater control authority and improved vehicle 780 performance.

Referring to FIG. 6, FIG. 7 and FIG. 9, a computer readable medium 902 having a plurality of computer executable instructions executed by a computer processor 706, executing program code 600, causes the computer processor 706 to perform a plurality of method operations of actuating robotic fin 100 maneuvers in association with platform vehicle 780, the computer executable instructions include: instructions performing a defining operation 1, where operation 1 defines a fin 100 gait and a combination of fin 100 and rib angle—time histories of a fin 100 stroke angle for at least rib 1, rib 2, rib 3, rib 4 and rib 5.

Again referring to, FIG. 6, FIG. 7 and FIG. 9, a plurality of method operations of actuating robotic fin 100 maneuvers in association with platform vehicle 780, further includes instructions performing a decision operation 2, selected from a group of decision operations consisting of deciding to repeat the defining operation 1 of defining preprogrammed fin 100 gait thrust directions or deciding to continue to a determining operation 3.

Again referring to, FIG. 6, FIG. 7 and FIG. 9, a plurality of method operations of actuating robotic fin 100 maneuvers in association with platform vehicle 780, further includes instructions performing the determining operation 3, using logic gates to determine which fin 100 gaits to combine based on desired fin 100 thrust.

Further referring to, FIG. 6, FIG. 7 and FIG. 9, a plurality of method operations of actuating robotic fin 100 maneuvers in association with platform vehicle 780, further includes instructions performing a calculating operation 4, calculating weighted percent of selected fin 100 gaits needed to produce desired fin 100 thrusts, selected in operation 3.

Again referring to Further, FIG. 6, FIG. 7 and FIG. 9, a plurality of method operations of actuating robotic fin 100 maneuvers in association with platform vehicle 780, further includes a combining operation 5, combining fin 100 and rib angles for each fin 100 gait thrust direction preprogrammed stroke time histories defined from selected gaits in the determining operation 3 and weights in the calculating operation 4.

Further referring to FIG. 6, FIG. 7 and FIG. 9, a plurality of method operations of actuating robotic fin 100 maneuvers in association with platform vehicle 780, further includes instructions sending commands, using computed fin 100 gaits selected from the combining operation 5 with user defined stroke amplitude and frequency, commanding fin 100 and rib control electronics to actuate actively controlled curvature of ribs, causing actively controlled robotic propulsion and steering maneuverability of onboard robotic fin 100, causing platform vehicle 780 to maneuver in a fluid medium.

While the exemplary embodiments have been particularly shown and described with reference to preferred embodiments thereof, it will be understood, by those skilled in the art that the preferred embodiments including the first exemplary embodiment, and the second exemplary embodiment have been presented by way of example only, and not limitation; furthermore, various changes in form and details can be made therein without departing from the spirit and scope of the invention. Thus, the breadth and scope of the present exemplary embodiments should not be limited by any of the above described preferred exemplary embodiments, but should be defined only in accordance with the following claim and/or claims and their equivalents. Any and/or all references cited herein are each entirely incorporated by reference herein, including all data, tables, figures, and text presented in the cited references. Also, it is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one of ordinary skill in the art. The foregoing description of the specific embodiments will so fully reveal the general nature of the invention that others can, by applying knowledge within the skill of the art, readily modify and/or adapt for various applications such specific embodiments, without undue experimentation, and without departing from the general concept of the exemplary embodiments. Therefore, such adaptations and modifications are intended to be within the meaning and range of equivalents of the disclosed embodiments, based on the teaching and guidance presented herein.

What is claimed is:

1. A computer processor having a plurality of computer executable instructions stored thereon to determine and actuate robotic fin motions in association with a vehicle, the robotic fin having at least two moving ribs, each rib driven by a fin-control actuator, the computer executable instructions comprising:

instructions for using logic gates to select which of a plurality of predetermined fin gaits to combine based on desired vehicle direction;

instructions for calculating a weighted percent of the selected fin gaits to combine based on desired fin thrust magnitude and direction;

instructions for combining the weighted percentages of selected fin gaits;

the combined weighted percentages of selected fin gaits, stroke amplitude, and frequency defining a fin stroke; and instructions for sending commands to the rib control actuators and to a fin control actuator to cause the fin to move through the fin stroke, thus maneuvering the vehicle through the fluid medium.

2. The computer processor according to claim 1, wherein each of the fin gaits for a fin is a time-sequence of fin angles and of rib angles for each of the moving ribs in the fin.

3. The computer processor according to claim 1, wherein the plurality of fin gaits includes a forward thrust gait, a reverse thrust gait, an upward thrust gait, a downward thrust gait, and a home/centered thrust gait.

4. The computer processor according to claim 1, wherein the robotic fin has at least five moving ribs.

5. The computer processor according to claim 1, wherein each of the fin gaits is defined in the computer implemented instructions as a set of discrete integer values of servo positions, each servo controlling rib angle or to the fin rotation.

6. The computer processor according to claim 1, the instructions further comprise instructions for interpolating between predefined angular positions to determine a position at an intermediate time before executing said instructions for using logic gates to select which of a plurality of predetermined fin gaits to combine based on desired vehicle direction.

7. The computer processor according to claim 6, wherein said instructions for interpolating comprise code according to

```
//decides which gait to run
int8_t kinematics_interpolate(uint8_t gait, float pcurrent, uint8_t pnext,
uint8_t i)
    {
    int8_t val1;
    int8_t val2;
    if(gait==NONE)
        return 0;
    else if(gait==FORWARD)
        {
        val1=forward_gait[i][(uint8_t)pcurrent];
        val2=forward_gait[i][pnext];
        }
    else if(gait==REVERSE)
        {
        val1=reverse_gait[i][(uint8_t)pcurrent];
        val2=reverse_gait[i][pnext];
        }
    else if(gait==LIFT)
        {
        val1=upward_gait[i][(uint8_t)pcurrent];
        val2=upward_gait[i][pnext];
        }
    else if(gait==DOWN)
        {
        val1=downward_gait[i][(uint8_t)pcurrent];
        val2=downward_gait[i][pnext];
        }
    else if(gait==DEMO)
        {
        val1=demo_gait[i][(uint8_t)pcurrent];
        val2=demo_gait[i][pnext];
        }
    else if(gait==HOME)
        {
        val1=home_gait[i][(uint8_t)pcurrent];
        val2=home_gait[i][pnext];
        }
    return interpolatef(fmod(pcurrent,1), 0, 1, val1, val2);
    } ;
Where int = integer
Where val = value
Where pcurrent = position_current
Where pnext = position_next.
```

8. The computer processor according to claim 1, wherein the instructions for calculating the weighted percentages to combine are characterized as the following actuation code instructions of calculating and interpolating kinematics:

```
//calculates and interpolates kinematics
void kinematics_calculate(uint8_t fin_gait[ ], float pcurrent,
uint8_t pnext)
    {
    for(int i=0; i<servos_per_fin; i++)//cycle through each servo
        {
        rib_position[FL][i] =
            (kinematics_interpolate(fin_gait[0],pcurrent,pnext,i)
```

-continued

```
            //make sure fits within servo movement
            if(amplification[FL] < 0)
                amplification[FL]=0;
                if(amplification[FL] > 1)
                amplification[FL]=1;
            //interpolate gait to match servo range, and factor in
            amplification
        rib_position[FL][i] = interpolate((int8_t)rib_position[FL][i],
        −100, 100,...
    DRIVE_SPEED_MIN*amplification[FL],...
                DRIVE_SPEED_MAX*amplification[FL]);
            }
            } ;
Where int = integer
Where val = value
Where pcurrent = position_current
Where pnext = position_next
Where FL = forward left.
```

9. The computer processor according to claim 1, wherein the instructions for combining the weighted percentages are characterized in the following actuation code instructions for running kinematics routines:

```
//runs the kinematics based on a timer
void kinematics(void)
    {
    //--------- start TIME PASSED CALCULATOR
    //get time passed
    t_stroke_end = clockGetus( );
    t_stroke_time_passed = t_stroke_end − t_stroke_start;
    //if timer goes over allowed time in stroke, reset
    if(t_stroke_time_passed > time_per_stroke_us)
            {
            t_stroke_time_passed −= time_per_stroke_us;//determine time that it
went over
            t_stroke_start = clockGetus( )−t_stroke_time_passed;//reset timer
            }
    //--------- end TIME PASSED CALCULATOR
    //--------- start DETERMINE ARRAY POSITION
    //determine position in kinematics to use, given current time passed
        float position_current = interpolatef(t_stroke_time_passed, 0,
    time_per_stroke_us,...
                    0, positions);
    //calculate the next position
            uint8_t position_next = position_current +1;
            if(position_next>(positions−1))
                position_next=0;
            //--------- end DETERMINE ARRAY POSITION
            //--------- start CALCULATE KINEMATICS
                kinematics_calculate(FL_gait,FL,position_current,position_next);
                //--------- end CALCULATE KINEMATICS
                //--------- start MBAB
    rib_position[FL][bulk]=interpolate(rib_position[FL][bulk],DRIVE_SPEED_MIN,...
    DRIVE_SPEED_MAX,min_bulk_LF,max_bulk_LF);
            //--------- end MBAB;
wherein FL refers to forward left, and
wherein MBAB refers to mean bulk angle bias.
```

10. The computer processor according to claim 1, wherein instructions for sending commands are characterized in the following actuation code:

```
        //--------- start Sending final commands to servos
        act_setSpeed(&rib1_FL,rib_position[FL][rib1]);
        act_setSpeed(&rib2_FL,rib_position[FL][rib2]);
        act_setSpeed(&rib4_FL,rib_position[FL][rib4]);
        act_setSpeed(&rib5_FL,rib_position[FL][rib5]);
        act_setSpeed(&bulk_FLf,rib_position[FL][bulk]);
        act_setSpeed(&bulk_FLr,rib_position[FL][bulk]);
        } ;
    wherein FL refers to forward left.
```

11. A computer-implemented method for execution by a computer processor having a plurality of computer executable instructions stored thereon for determining and actuating robotic fin motions in association with a vehicle, the robotic fin having at least two moving ribs, each rib driven by a fin-control actuator, the method comprising:

using logic gates to select which of a plurality of predetermined fin gaits to combine based on desired vehicle direction;

calculating a weighted percent of the selected fin gaits to combine based on desired fin thrust magnitude and direction;

combining the weighted percentages of selected fin gaits;

the combined weighted percentages of selected fin gaits, stroke amplitude, and frequency defining a fin stroke; and sending commands to the rib control actuators and to a fin control actuator to cause the fin to move through the fin stroke, thus maneuvering the vehicle through the fluid medium.

12. The method according to claim 11, further comprising: defining a plurality of fin gaits for a fin.

13. The method according to claim 11, wherein each of the fin gaits for a fin is a time-sequence of fin angles and of rib angles for each of the moving ribs in the fin.

14. The method according to claim 11, wherein the plurality of fin gaits includes a forward thrust gait, a reverse thrust gait, an upward thrust gait, a downward thrust gait, and a home/centered thrust gait.

15. The method according to claim 11, wherein the robotic fin has at least five moving ribs.

16. The method according to claim 11, wherein each of the fin gaits defines is defined in the computer implemented instructions as a set of discrete integer values of servo positions, each servo controlling rib angle or to the fin rotation.

17. The method according to claim 11, further comprising interpolating between predefined angular positions to determine a position at an intermediate time before using logic gates to select which of a plurality of predetermined fin gaits to combine based on desired vehicle direction.

* * * * *